US006003635A

United States Patent [19]

Bantz et al.

[11] Patent Number: 6,003,635

[45] Date of Patent: Dec. 21, 1999

[54] PORTABLE DEVICE AND METHOD FOR ENHANCED RECOVERY OF LUBRICANTS FROM ENGINE SUMPS AND THE LIKE

[75] Inventors: Michael R. Bantz, Shorewood, Minn.; Jorge Del Castillo, Wilmette, Ill.; Louisa Hayward, Glenview, Ill.; Arun Menawat, Lake Forest, Ill.

[73] Assignee: Kwik-Konnect, Inc., Glenwood, Ill.

[21] Appl. No.: 09/059,093

[22] Filed: Apr. 13, 1998

[51] Int. Cl.[6] ..... F16C 3/14

[52] U.S. Cl. ..... 184/1.5; 184/28; 184/58

[58] Field of Search ..... 184/1.5, 28, 58

[56] References Cited

U.S. PATENT DOCUMENTS

| | | | |
|---|---|---|---|
| 1,659,047 | 2/1928 | Quinn . | |
| 1,818,122 | 8/1931 | Engbrecht . | |
| 1,846,877 | 2/1932 | Knapp . | |
| 2,105,761 | 1/1938 | Wood | 184/1.5 |
| 3,387,621 | 6/1968 | Schaff | 137/322 |
| 3,806,085 | 4/1974 | Codo | 251/144 |
| 4,269,237 | 5/1981 | Berger | 141/346 |
| 4,745,894 | 5/1988 | Laipply et al. | 123/196 R |
| 4,807,674 | 2/1989 | Sweet | 141/59 |
| 4,951,723 | 8/1990 | Hoeptner, III | 141/351 |
| 4,977,978 | 12/1990 | Batrice | 184/1.5 |
| 5,117,876 | 6/1992 | Kuntz | 141/7 |
| 5,130,014 | 7/1992 | Volz | 210/130 |
| 5,454,960 | 10/1995 | Newsom | 210/805 |
| 5,467,746 | 11/1995 | Waelput et al. | 123/196 A |
| 5,476,154 | 12/1995 | Sage | 184/1.5 |
| 5,667,195 | 9/1997 | McCormick | 251/149.6 |
| 5,881,840 | 3/1999 | Mize | 184/1.5 |

OTHER PUBLICATIONS

Don Sherman, "GM's Enviromentally Safe Oil Change", *Popular Science,* May 1996, p. 48.

Undated Hansen product litertature entitled "One–Way Shut–Off Couplings." (Available at time of filing).

Undated Swagelok Co. product literature entitled "Gageable Tube Fittings and Adapter Fittings." (Available at time of filing).

*Primary Examiner*—Tamara L. Graysay
*Assistant Examiner*—David Fenstermacher
*Attorney, Agent, or Firm*—Fitch, Even, Tabin & Flannery

[57] ABSTRACT

A device for recovering fluid from a reservoir having a lower drain. The device includes a first coupling connectable to a drain of a reservoir and having an internal passage for fluid flow therethrough. A conduit has one end connected to the first coupling for fluid flow into the conduit and a second end opposite the first end with a valve to control fluid flow through the conduit. A probe, defining a fluid passage, has a tip portion for actuating the valve from its normally closed position to an open position upon insertion of the tip portion in the valve to allow fluid flow through the valve and the probe. A portable receptacle is attached to the probe for collecting fluid when the valve is actuated to the open position. A portable pump reduces the pressure in the receptacle to draw fluid through the conduit and into the receptacle. The conduit includes a multi-layer construction wherein the inner layer includes material for reducing friction to enhance fluid flow and an outer later for protecting the inner layer.

25 Claims, 3 Drawing Sheets

PORTABLE DEVICE AND METHOD FOR ENHANCED RECOVERY OF LUBRICANTS FROM ENGINE SUMPS AND THE LIKE

FIELD OF THE INVENTION

The present invention relates to recovering fluids, such as lubricants, from sumps of internal combustion engines and the like and, more particularly, to a portable device and method for controlled and enhanced drainage and collection of such fluid and for convenient disposal of such collected fluid.

BACKGROUND OF THE INVENTION

Many internal combustion engines require lubrication systems that pump and distribute a durable lubricant throughout the engine to prevent wear and permanent damage to interfacing components. In a typical engine, the lubricant is pumped from a sump or reservoir and throughout the distribution network in the engine. Due to temperature related viscosity considerations for typical engine lubricants, such as oil, the reservoir or sump commonly is located lower on the engine or even underneath the engine so that the temperature of the lubricant can be lowered before being pumped back through the engine. The lubricant generally returns to the sump under gravity.

The automobile is one of the most common applications of the internal combustion engine. A typical automobile engine requires a lubrication system of the type generally described above. It is well understood that the failure to change the engine oil on a regular basis tends to result in foreign material or contaminant build-up that adversely affects engine performance and efficiency and, ultimately, causes wear and other permanent damage to engine components. To lessen this effect, most automobile manufacturers recommend changing the engine oil every 3,000 to 3,500 miles, which results in at least four oil changes annually per automobile based on an estimated 12,000 to 14,000 miles per year. Thus, a significant number of oil changes occur each year resulting in significant revenue to suppliers in the oil replacement market.

Consumers of the automobile engine oil replacement market include a significant segment of automobile owners that undertake changing their own oil, which is commonly referred to as the "do-it-yourselfers" segment. Overall, these do-it-yourselfers perform approximately 60 percent of the total number of domestic oil changes and constitute about 50 percent of the revenues. Studies, however, reveal that this particular segment would undergo meaningful growth if engine oil replacement could be made easier, less time consuming and safer. Moreover, achieving these goals also would encourage and enable automobile owners to more easily maintain proper maintenance schedules, which in turn would reduce overall repair expenses and improve the quality of older engines.

For most automobiles, changing the oil is not always an easy, safe and expeditious task, especially for the do-it-yourselfers. At the outset, this task requires sufficient and safe access to the oil pan typically located at the bottom of the engine underneath the automobile. The first step, thus, is to either raise the automobile with a portable hydraulic jack or drive the automobile up a ramp, over a sufficiently deep trench or onto a hydraulic lift platform. In many instances, do-it-yourselfers do not have access to such equipment or facilities to properly elevate the automobile and, as a result, resort to using other less desirable equipment or simply climbing under the automobile on the ground.

The next step is to remove the drain plug from the oil pan drain hole commonly located near the bottom of the oil pan. Plug removal causes the oil to drain from the oil pan in a substantially uncontrolled manner generally under pressure resulting from only gravity. Since the drain hole and plug do not adequately facilitate fluid flow control upon plug removal, a containment method must be employed that is capable of collecting and capturing the oil as it drains and splashes through the drain hole.

After the used engine oil has drained from the pan, the drain plug must be properly reinstalled to seal against leakage. Experience has revealed that reinstallation of the drain plug raises potential for numerous problems. The most noteworthy problems are associated with the failure to properly reinstall the drain plug, resulting in leakage and, ultimately, permanent engine damage. These results stem from stripped threads in the drain hole and on the plug due to misalignment of the drain plug and stripped faces on the hex nut portion of the drain plug resulting from the use of an incorrectly sized tool. Other problems include introduction of contaminants into the engine from a dirty drain plug and environmental contamination from a leaky plug reinstallation or complete failure to reinstall the drain plug.

To address problems associated with drain plugs, numerous valved plugs have been designed to replace the drain plug. A conventional valved plug typically includes a socket in which operates a spring biased socket valve for opening and closing the valve. The spring biases the socket valve to a closed position, and a probe is used to actuate the socket valve against the spring to an opened position. Examples of valved plugs are disclosed in U.S. Pat. Nos. 1,659,047; 1,818,122; 1,846,877; 3,387,621; 3,806,085; 4,269,237; 4,745,894 and 4,951,723.

Shortcomings with valved plugs include their inconveniently located disconnect location. Commonly, the valved plug simply replaces the conventional plug at the drain hole and, thus, does not address the problems with access to the oil pan underneath the automobile. Moreover, because the valved plug is commonly located at the bottom of the sump or oil pan, there is no protection against possible leakage AT the valved plug.

Although some of these devices pertain solely to drain plug valves and their operations, others also disclose entire systems for recovering the oil from the automobile sump, including devices for connecting to and operating the valved plug. These recovery systems also have obvious disadvantages, which stem from their relatively large scale, elaborate pumping and storage equipment. These systems are permanent type systems that would be found typically in car service centers or quick-change oil facilities. It is readily apparent that they do not address portability and economic concerns of the do-it-yourselfers.

One known device that addresses portability is disclosed in U.S. Pat. No. 4,269,237 listed above. This device is a portable device for collecting oil from an automobile engine and includes a shallow vessel that interconnects to the valved drain plug via a hose. The hose has a drain spigot that operates the valved drain plug upon insertion to allow oil flow to the shallow vessel.

A known shortcoming with this design is the sole reliance on gravity to drain the oil from the oil pan. In this design, gravity is the sole force responsible for causing the oil to drain through the relatively small diametered drain hole and hose and into the vessel located only a number of inches below the oil pan. For example, a common drain hole is approximately 0.25 inches in diameter, and the vertical distance between the oil pan and the ground is typically in the range of 6 to 12 inches below. Experience has revealed that draining a typical oil pan solely under gravity can easily exceed five minutes or more, especially under relatively cold conditions where oil flow may occur only at an extreme minimum or not even at all. These relatively slow flow conditions are ineffective for the most part because one is forced to wait idle until the oil pan is drained.

In an attempt to address this shortcoming, collection vessels have been designed to have a low profile to increase the vertical drop. For example, one known collection vessel has a low profile and pyramid shape. Although this design is an attempt to increase flow, it still relies solely on gravity and renders the vessel awkward to handle and transport. Thus, a desire exists for a portable device that significantly enhances the rate of fluid flow to reduce drainage time and that employs a more transportable collection receptacle.

Overall, the customary oil change process is relatively time consuming and impractical for individuals not possessing or having access to specialized facilities, equipment and tools. Moreover, the equipment used to raise automobiles can tend to increase hazardous risk to the do-it-yourselfer that must crawl underneath the automobile. Thus, there is also a desire to eliminate having to operate underneath the automobile during the oil change process.

Other concerns for do-it-yourselfers include health risks associated with exposure to used engine oil which is considered carcinogenic. It is well understood that one should avoid contact with such oils by wearing protective clothing, eyewear and gloves during oil change procedures, especially those requiring removal of a drain plug followed by uncontrolled discharge of oil from the oil pan. On the other hand, it is also well known that using car service centers and quick change oil facilities is relatively expensive and time consuming and does not entirely eliminate the risks described above associated with reinstallation of the oil drain plug.

Thus, the present invention is directed to a drainage method and portable device that provides controlled and enhanced recovery of lubricants from engines. More specifically, the present invention provides a drainage method using a highly portable device that transfers the engine lubricant to a more accessible drain location and enables selective, controlled and enhanced flow of such liquid from such location to a readily transportable collection receptacle in a manner that reduces harmful exposure.

SUMMARY OF THE INVENTION

The present invention is directed to a device for recovering fluid from a reservoir having a lower drain. The device includes a first coupling connectable to a drain of a reservoir and having an internal passage for fluid flow therethrough. A conduit has one end connected to the first coupling for fluid flow into the conduit and a second end opposite the first end. The conduit includes a valve at the second end to control fluid flow through the conduit. The valve is normally set to a closed position to prevent fluid flow through the conduit. A probe defining a fluid passage has a tip portion for actuating the valve from the closed position to an open position upon insertion of the tip portion in the valve to allow fluid flow through the valve and the probe. A portable receptacle is attached to the probe for collecting fluid when the valve is actuated to the open position. A portable pump reduces the pressure in the receptacle to draw fluid through the conduit and into the receptacle.

The device also may include a second coupling intermediate the probe and the receptacle. The second coupling has a first passage communicating with the probe to allow fluid flow into the receptacle and a second passage communicating with the pump. The first passage of the second coupling also may extend into the reservoir beyond the second passage. The second passage also may include filtering material that substantially prevents fluid flow through the second passage.

The pump may be an electrically driven pump that is selectively activated to reduce the pressure in the receptacle. Alternatively, the pump may be a manual pump that is selectively operated to reduce the pressure in the receptacle to draw fluid into the receptacle when the probe actuates the valve to the open position. The manual pump also may include a resilient, compressible body portion having an expanded position and a collapsed position and an inlet and an outlet. The inlet allows air to be drawn from the receptacle as the bellow body normally shifts from the collapsed to the expanded position, and the outlet allows air to discharge from the bellow body as the bellow body is manually shifted from the expanded position to the collapsed position.

Alternatively, the device may include a substantially flexible receptacle and may be made substantially from biodegradable material. The device also may include a portable shell that is substantially rigid and is capable of substantially surrounding the flexible receptacle. Further, the substantially rigid shell may have an openable portion for allowing the flexible receptacle to be inserted therein and removed therefrom.

In another alternative embodiment, a device for recovering fluid from a reservoir having a lower drain includes a coupling connectable to the reservoir drain and having an internal passage for fluid flow therethrough. A conduit has a first end connected to the first coupling for fluid flow into the conduit, a second end opposite the first end for discharging fluid flow from the conduit and a multi-layer construction between the first and second ends. The multi-layer construction includes an inner layer with a friction reducing surface to enhance fluid flow therethrough and an outer layer to limit damage to the inner layer. A removable closure seals the second end of the conduit to prevent fluid discharge therefrom. The reservoir may be attached to the underneath of a motorized vehicle, and the conduit may be substantially flexible and extendable to at least the outer perimeter of the motor vehicle.

The conduit may be in the range of at least 1 to five feet in length to extend to the outer perimeter of the motorized vehicle. The second end of the conduit may be adapted to be connected to the motorized vehicle above the reservoir to reduce fluid pressure in the conduit at the second end.

The inner and outer layers may be separate inner and outer tubes wherein the inner tube is substantially within and substantially surrounded by the outer tube. The inner tube may include friction reducing material to allow fluid flow therethrough, such as synthetic resinous fluorine, including that in the form sold under the trademark TEFLON®. Alternatively, the inner tube may be made of polymeric material.

The outer tube may be made substantially of flexible metal structure to protect the inner tube. Alternatively, the outer tube may be made substantially of a plastic material sufficient to protect the inner tube.

The present invention also is directed to a method for recovering fluid from a reservoir having a lower drain. The method includes attaching a first coupling having an internal passage for fluid flow to a drain of a reservoir. A conduit has a first end connected to the first coupling and a second end having a valve to control fluid flow through the conduit. The valve is normally set to a closed position to prevent fluid flow therethrough. A probe defining a fluid passage and having a tip portion is inserted in the valve for actuating the valve from the closed position to an open position to permit fluid flow therethrough A portable receptacle is attached to the probe. A portable pump is activated to reduce pressure in the receptacle to draw fluid through the conduit and into the receptacle. Upon completion, the probe is disconnected from the valve to shift the valve to the closed position.

The method may include closing the portable receptacle for transport. The method may further include, where the portable receptacle is substantially flexible, the step of inserting the portable receptacle in a substantially rigid container. The method also may include the step of locating the second end of the conduit above the reservoir after disconnecting the probe from the valve to reduce the pressure at the second end.

BRIEF DESCRIPTION OF THE DRAWINGS

The present invention will be described in connection with the accompanying drawings wherein.

DETAILED DESCRIPTION OF THE PREFERRED EMBODIMENT

Figure 1:
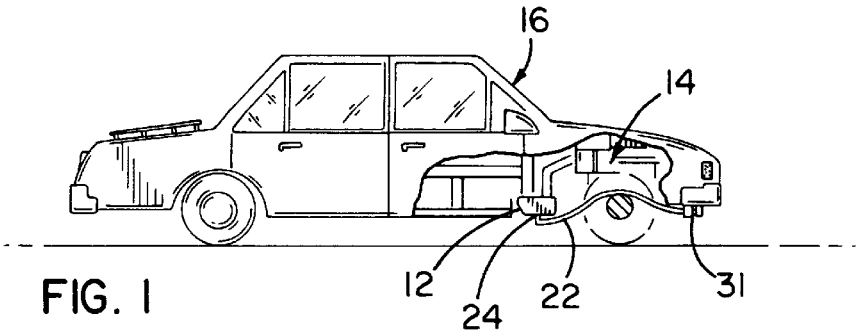
FIG. 1 is a side elevational view of an automobile, partially cut away, to illustrate a valved conduit assembly for a portable system for enhanced recovery of lubricants from engine sumps and the like in accordance with the present invention.
Figure 2:
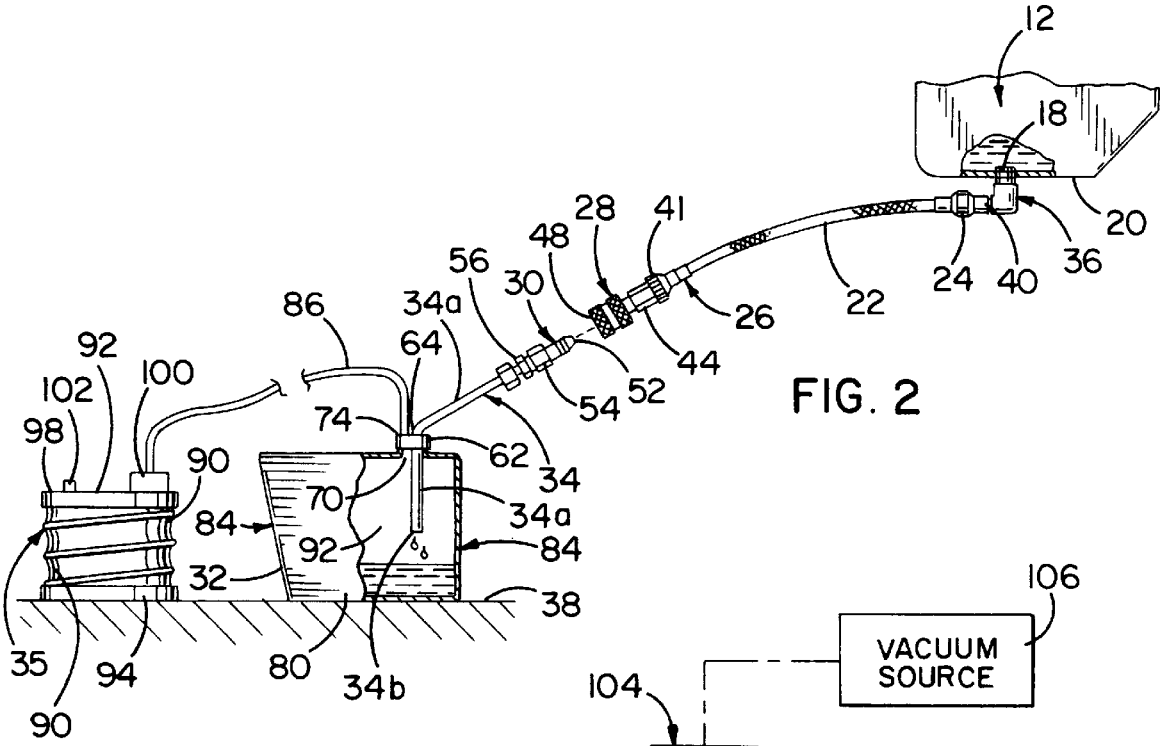
FIG. 2 is a side elevational view of a portable system, partially cut away and exploded, for enhanced recovery of lubricants from engine sumps and the like in accordance with the present invention and including the conduit assembly of FIG. 1.

Referring to FIGS. 1 and 2, there is illustrated a portable system 10 for enhanced recovery of lubricants, such as oil, from a lower sump 12 of an internal combustion engine 14, such as that of an automobile 16. As shown, the lower sump 12, commonly referred to as an oil pan, is located underneath the automobile 16 at the bottom of the engine 14. The oil pan 12 has a threaded drain hole 18 extending through its bottom wall 20 for draining the oil pan 12 in order to replace the used oil with fresh oil.

The portable system 10 includes a conduit 22 with a first end 24 remaining connected to the oil pan 12 at the drain hole 18 and an opposite, second end 26 adapted to be fitted with a selectively, controllable valved coupling 28. The conduit 22 has sufficient length so that the second end 26 can be extended to a readily accessible location for quick oil changes without having to extend underneath the automobile 16 to the oil pan 12. Such location is preferably at the forward end of the automobile, such as in the engine compartment near the radiator or the front wheel, but may also be at the sides of the automobile. This length can be in the range of one to eight feet. It also is recommended to attach the second end 26 to the automobile, when not is use, at an elevation above the oil pan 12 to eliminate fluid pressure and, therefore, protect against possible leakage at the second end 26.

To operate the valve 28, a hollow probe 30 connected to a collection receptacle 32 with an extension tube 34 operates the valve 28. To open the valve 28, the probe 30 is inserted and locked into the valve 28. The system 10 also includes a pump 35 to increase the flow rate for draining the oil pan 12 by reducing the pressure in the receptacle 32. Drainage of a typical oil pan can be accomplished with the present invention in an upper range of about 1–2 minutes with adequate reduction of pressure in the receptacle. To enhance oil recovery, it is recommended that the temperature of the oil in the oil pan be raised above atmosphere conditions, such as by running the engine for a short time period prior to recovery, in order to improve the oil's flow from the oil pan.

Upon complete drainage of the oil pan 12, the valve 28 is closed by removing the probe 30, and the valved end 26 of the conduit 22 is securely attached to the automobile 16 at a readily accessible location, such as near the radiator, with a clamp 31. The receptacle 32 then is readily portable for transport to a disposal facility, such as an auto care center, gas station or other used oil collection facility. Overall, the system 10 enables quick and effective recovery of used engine oil from the oil pan without having to operate underneath the automobile and having to consume an undesirable amount of time and exposure to the used engine oil.

Referring to FIG. 2, the first end 24 of the conduit 22 is attached to the oil pan 12 using an elbow fitting 36 dimensioned to be screwed into the drain hole 18 with a sealed fit. The preferred elbow fitting is a 90 degree male elbow fitting made from any suitable material, such as brass, aluminum or steel, and has threaded male ends wherein one end is adapted to be turned into the drain hole 18 with a threaded pressure fit and the other end is adapted to receive the first end 24 of the conduit 22 with a threaded pressure fit. Alternatively, a female elbow fitting, along with suitable male connectors, may be used to attach the conduit to the oil pan. In either case, long life type gaskets commercially available are recommended to seal the fitting junctions with both the oil pan and the conduit.

More specifically, the male elbow fitting 36 has a conduit end 40 and is turned into the drain hole 18 of the oil pan 12 with a threaded pressure fit so that the conduit end 40 preferably has its axial centerline parallel to the ground 38. The conduit end 40 also is preferably directed toward the front of the automobile 16 to provide a directed path for the oil to flow out of the oil pan 12; however, the conduit end 40 also can be directed toward either of the sides of the automobile. The first end 24 of the conduit 22 has a sealed and threaded pressure engagement with the conduit end 40 of the elbow fitting 36.

With a fixed style elbow fitting, the desired direction of the conduit end is set by first carefully preselecting the initial direction of the conduit end before turning the opposite fitting end into the drain hole so that the final turn sets the conduit end to open in the desired direction. The preferred elbow, however, is a positionable male elbow fitting that allows the conduit end to swivel so that it can be set at the desired direction after the elbow fitting has been turned into the drain hole of the oil pan. The positionable style fitting also allows for quick relocation of the second end 26 of the conduit 22 for attachment to the automobile or oil recovery at different locations. The foregoing elbow fittings are commercially available, such as from Swagelok Corporation of Solon, Ohio.

Figure 7:
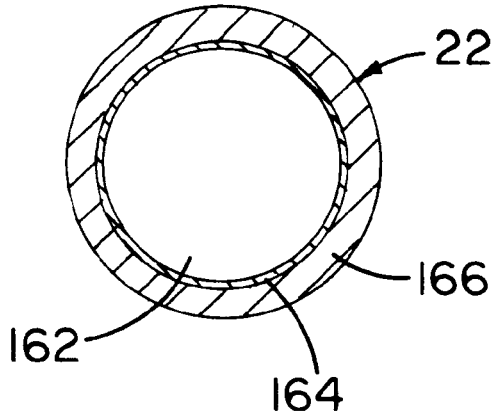
FIG. 7 is a cross-sectional view of a multi-construction conduit used in accordance with the present invention.

The conduit may be a rigid metal tube or, preferably, a flexible tube construction with a suitable outer surface or other structure mounted to the automobile that sufficiently protects the tube against damage. Referring to FIG. 7, the preferred conduit 22 is a flexible, multi-layered construction with concentric tube layers in which the inner tube layer 164 is of a natural or synthetic polymeric including synthetic resinous fluorine, such as that in the form sold under the trademark TEFLON®, that defines the fluid flow path 162, and the outer protective tube layer 160 is of a stainless steel braided sheath or flexible high impact material, such as plastic, in order to protect the inner tube. The preferred materials for the multi-layered construction include a friction reducing inner tube of synthetic resinous fluorine, such as that in the form sold under the trademark TEFLON®, concentrically surrounded by a flexible high impact plastic outer tube. Such foregoing tubes are commercially available, such as from Swagelok Corporation.

The second end 26 of the conduit 22 has a male NPT end connector 42 that is screwed into a female NPT end connector 44 of the one way quick connect/disconnect valved coupling 28 with a sealed threaded pressure fit engagement. The preferred coupling 28 defines an axially extending quick connect/disconnect valve socket body 48 that provides access for the probe 30 to a socket valve (not shown) normally biased by a spring (not shown) in the body 48 to a closed position to prohibit flow through the coupling 28. The probe 30 is a quick connect/disconnect type probe that has a tip portion 52 that selectively operates the valve socket of the coupling 28 from its normally closed position to an open position in which oil flows through the coupling 28.

More specifically, when the probe 30 is inserted and engaged in the socket body 48, the probe tip 52 moves the socket valve axially in the socket body 48 against the spring to open the coupling 28. The probe 30 is releasably locked in the valve body 48 using any commercially available and suitable locking mechanism, such as locking balls and a sleeve spring mounted in the socket body designed to cooperate with an annular groove on the probe or other means, including cooperating grooves and pins on the socket body and the probe, respectively, held in engagement by a spring arrangement. Such valves are commercially available.

The probe 30 has a female NPT end connector 54 screwed on to a straight tube fitting 56 with a male NPT end connector with a sealed, threaded pressure fit engagement. The straight tube fitting 56 mounts the probe 30 to the extension tube 34 that in turn connects to the receptacle 32. The extension tube 34 is made of any tubing material suitable of transferring fluids at higher temperatures, such as engine oils at temperatures in the range of 250 to 350 degrees Fahrenheit, and is preferably made of a rigid metal material.

Figure 4:
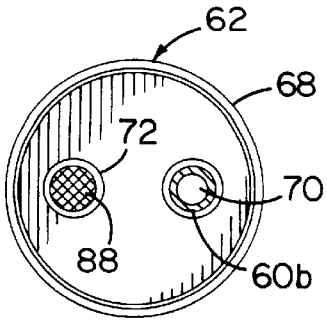
FIG. 4 is a bottom view of the cap-like coupling of the portable system of FIG. 2 illustrating dual passages and a filter element.

Referring to FIGS. 2 and 4, the tube 34 is affixed to the receptacle 32 with a cap like coupling 62. The tube 34 is segmented into a first and second segment 34*a* and 34*b*, respectively, by a bend 64 located adjacent the cap coupling 62. the cap coupling 62 includes a top portion 66 and a depending skirt portion 68. The top portion 66 defines a fluid inlet port 70 and an air outlet port 72. The ports 70 and 72 are parallel and adjacent to one another through the top portion 66. The second segment 34*b* of the tube 34 extends through the fluid inlet port 70 with a friction fit and into the receptacle 32 to sufficiently space a fluid discharge end 34*c* of the tube 34 away from the cap coupling 62 to guard against fluid being drawn through the air outlet port 72 by the pump 34. The preferred spacing places the discharge end 34*c* at least half the depth of the receptacle 32.

The cap coupling 62 has a threaded engagement with the receptacle 32. More specifically, the depending skirt portion 68 includes internal threads 78 that cooperate with complimentary threads (not shown) on an upstanding neck portion 74 (phantom) at the top of the receptacle 32. The neck portion 74 defines a receptacle discharge port 76 that is exposed by removing the cap coupling 62 for pouring out collected lubricants.

The receptacle 32 has a substantially outer rigid shell 80 defining an interior cavity 82 having volume sufficient enough to hold the desired amount of collected lubricant. A typical oil pan contains approximately 5 to 7 quarts of oil, depending on the size of the engine. The shell is manufactured from any suitable lightweight material with sufficient density to hold lubricants such as oil. The receptacle 32 also includes a pair of handles 84 or hand holds to easily grip and lift the receptacle 32 for easily transporting and dispensing of its contents. The receptacle and the cap may be inexpensively injection or blow molded from a suitable plastic material.

The pump 35 is connected to the receptacle 32 with an air suction line 86 friction fitted into or thread fitted at the air outlet port 72. To prevent lubricant from being drawn through the air outlet port 72, the air line 86 does not extend into the receptacle 32. Moreover, the air outlet port 72 includes a filtering material 88 that is intended to allow only air, and not fluid, such as engine oil, to pass through the port 72 into the air suction line 86.

The pump 35 draws air from the receptacle 32 to generate the desired pressure reduction to enhance the flow rate of the oil from the oil pan 12 into the receptacle 32. The pump may be of any conventional type, such as a cylinder pump or balloon style, and is to be lightweight and easy to operate. As shown in FIG. 2, the pump 35 is a lightweight manually operated pump that includes a hollow bellow body portion 90 with a generally cylindrical shape and a circular top 92 and bottom 94.

The top 92 defines an inlet passage 96 (phantom) for drawing air from the receptacle 32 through the air suction line 86 and an outlet passage 98 (phantom) for discharging air from the bellow body portion 90 to the atmosphere. The inlet passage 96 includes a one-way valve 100 that permits air to flow into the bellow body portion 90 through air suction line 86 and prevents air from discharging from the bellow body portion 90 through the inlet passage 96. Similarly, the outlet passage 98 also includes a one-way valve 102 that only permits air to discharge from the bellow body portion 90 to the atmosphere.

The bellow body portion 90 is resiliently biased to a normal expanded state (as shown). However, when the bellow body portion 90 is shifted manually to a compressed state, air is discharged through the air outlet passage 98. As the bellow body portion 90 is released and shifts normally to the expanded state, it draws air from the receptacle 32 to reduce the pressure for enhanced fluid flow.

Figure 3:
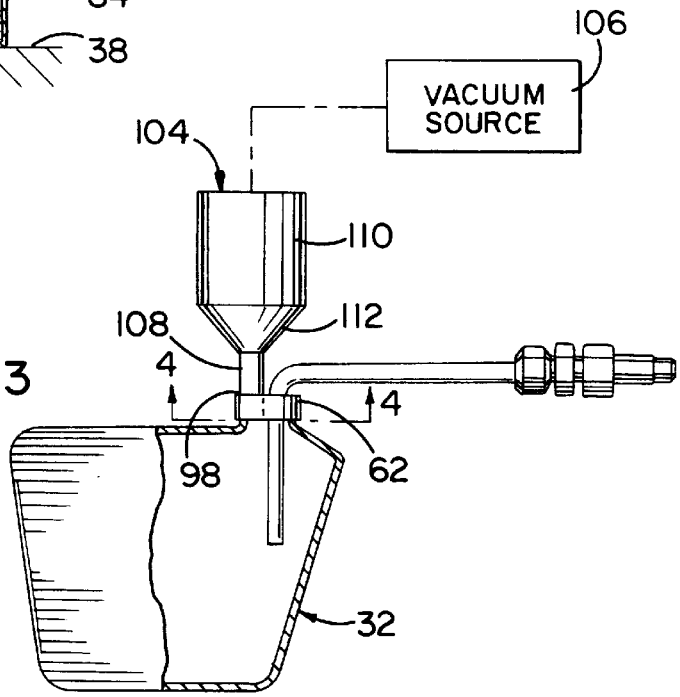
FIG. 3 is a side elevational view of a receptacle in accordance with the present invention illustrating an alternative coupling for attaching a pump to the receptacle.

Referring to FIG. 3., the system 10 alternatively includes an adapter 104 at the outlet passage 98 of the cap coupling 62 for attachment to an alternative pump source 106. The preferred alternative pump source is an electrical pump, such as a conventional vacuum cleaner (not shown) in which the vacuum hose is connected to the receptacle 32 via the adapter 104 with a friction fit.

The system also may include a flexible bladder to contain the recovered oil and that may be used as a liner for the receptacle. The bladder may be made of any suitable material with density sufficient to contain the desired fluid, which may be at higher temperatures, such as engine oil in the temperature range of about 250 to 350 degrees Fahrenheit. Such material may be any suitable high temperature polymer material or high temperature paper with a plastic type coating, and such material is commercially available.

Figure 5:
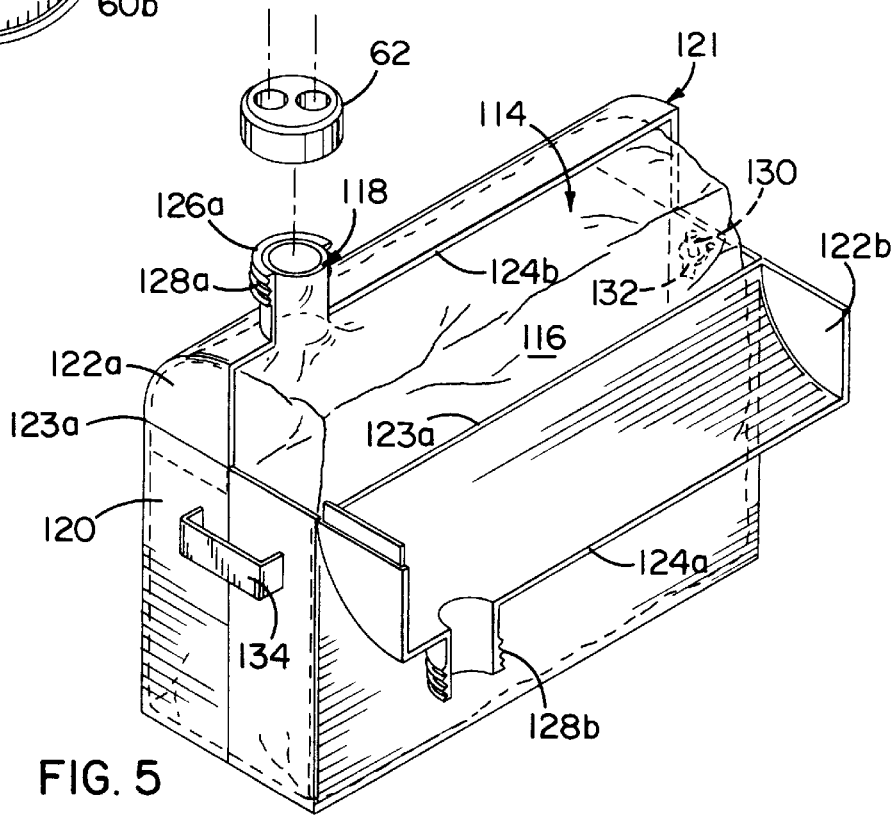
FIG. 5 is a perspective view of an alternative flexible bladder receptacle for use in a portable system for enhanced recovery of lubricants from engine sumps and the like in accordance with the present invention.

More specifically, referring to FIG. 5, the system 10 is illustrated to include a flexible bladder 114. The bladder 114 defines an internal bladder cavity 116 of sufficient volume to hold the desired amount of collected fluid. The bladder 114 includes a neck portion 118 at its upper portion. The bladder 114 is sized to fit in a transportable retention housing 120 having an upper top portion 121 that opens for insertion and removal of the bladder 114.

More specifically, the upper portion 121 includes left and right longitudinally extending, arcuate doors 122*a* and 122*b*, respectively, that open along a hinge 123*a* and 124*a*, respectively. The housing may be made from any suitable lightweight material providing adequate rigidity, such as plastic, and the hinges may be living type hinges formed by lines of weakness in the material.

The doors 122*a* and 122*b* open away from one another and close along a opposing edges 124*a* and 124*b*, respectively. Each door 122*a* and 122*b* includes a semicircular neck portion 126*a* and 126*b* that mate when the doors 122*a* and 122*b* are closed to define a circular passage for the neck portion 118 of the bladder 114. The neck portion 188 of the bladder 114 has a friction engagement with the inner surface of the circular passage. Each neck portion 126*a* and 126*b* includes external threads 128*a* and 128*b*, respectively, so that the cap coupling 62 can be turned on the neck portions 126*a* and 126*b* to attach the extension tube 34 and the air suction line 86 or the adapter 104. The cap coupling 62 also acts to latch the doors 122*a* and 122*b* in the closed position. To prevent the bladder 114 from collapsing during initial stages of the oil recovery process, a hook 130 may be provided in the housing 120 at the end of the housing 120 opposite the neck portions 126*a* and 126*b* to hook a loop 132 on the outside of the bladder 114. The inside surface of the bladder may be coated with an anti static material to assist in preventing bladder collapse. On the exterior, the housing 120 includes handles 134 to grip and lift the housing 120 for transport.

Figure 6:
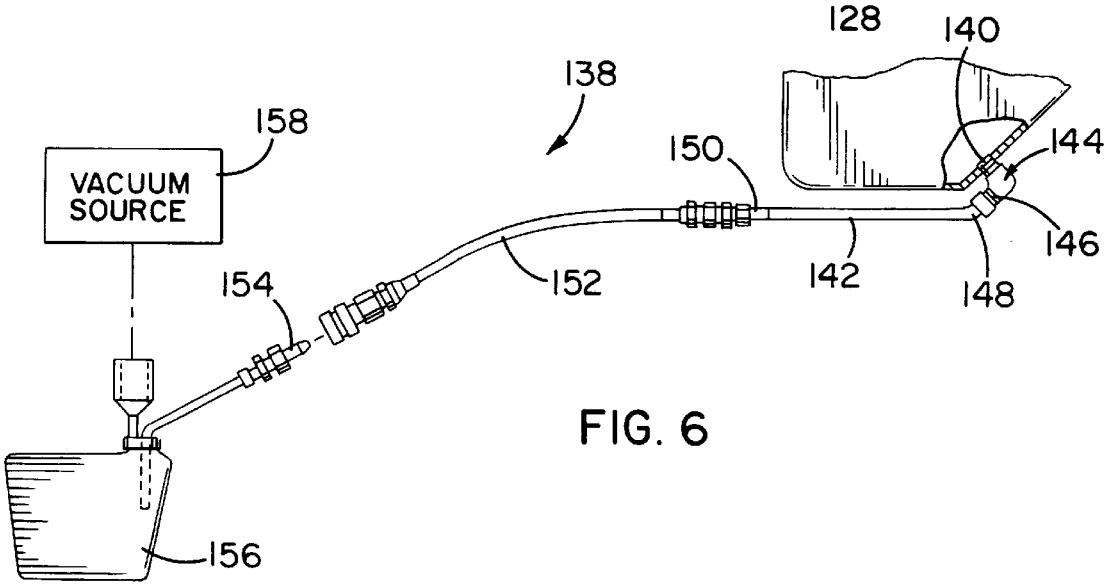
FIG. 6 is a side elevational view of an alternative portable system for enhanced recovery of lubricants from engine sumps and the like in accordance with the present invention.

Referring to FIG. 6, there is illustrated another embodiment in which a system 136 in accordance with the present invention is modified for use with an engine oil pan 138 having a rear drain hole 140. The system 136 is identical to the above-described systems with the primary exception of a second extension tube 142 extending from an elbow fitting 144 at the oil pan 138.

More specifically, the elbow fitting 144 is turned into the drain hole 140 with its open end 146 angling downward. The second extension tube 142 has a first end 148 bent adjacent the attachment to the elbow fitting 144 so that most of the tube 142 extends parallel along the bottom of the oil pan 138. The other end 150 of the second extension tube 142 attaches to a flexible, valved conduit 152 for operation by a probe 154 attached to a collection receptacle 156. A pump source 158 communicates with the receptacle 156 to reduce the pressure for enhanced fluid flow from the oil pan 138 to the receptacle 156.

Figure 8:
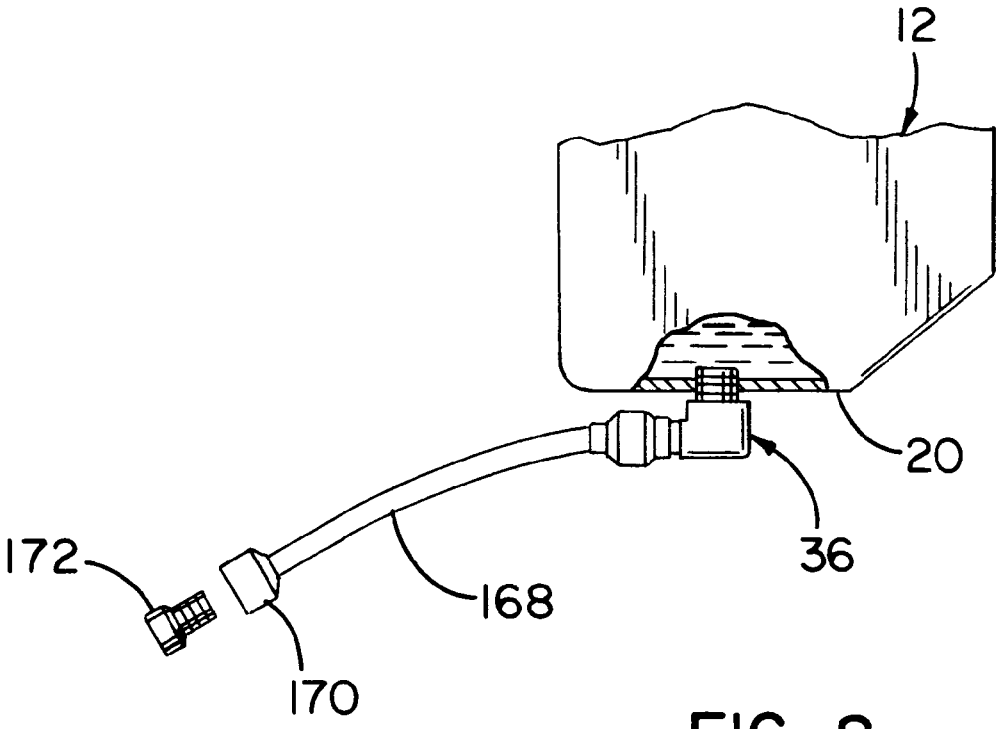
FIG. 8 is a side elevational view of an alternative portable system, partially cut away and exploded, for enhanced recovery of lubricants from engine sumps and the like in accordance with the present invention.

Referring to FIG. 8, there is illustrated another further embodiment in which a system 166 in accordance with the present invention is modified for use in a high volume service operation. The system 166 includes the identical conduit and attachment to the oil pan as for the above-described system with the primary exception being that the conduit 168 includes a second end 170 designed to receive a threaded, pressure fit closure or plug 172.

Thus, to drain the oil pan 12, the second end 170 is detached from the automobile, and the plug cap 172 is unscrewed from the second end 170. The second end 170 then is lowered below the oil pan 12 and fluid is allowed to drain. Once the oil pan 12 has been drained completely, the plug cap 172 is reinstalled at the second end 170 of the conduit 168 with a sealed, pressure fit.

It will be understood that various changes in the detail, materials and arrangement of parts and assemblies which have been herein described and illustrated in order to explain the nature of the present invention may be made by those skilled in the art within the principles and scope of the present invention as expressed in the appended claims.

What is claimed is:

1. A device for recovering fluid from a reservoir having a lower drain comprising:

a first coupling connectable to a lower drain of a reservoir and having an internal passage for fluid flow therethrough;

a conduit having a first end connected to the first coupling for fluid flow into the conduit and a second end opposite the first end;

a valve at the second end of the conduit to control fluid flow through the conduit and being normally set to a closed position to prevent fluid flow therethrough;

a probe defining a fluid passage and having a tip portion for actuating the valve from the closed position to an open position upon insertion of the tip portion in the valve to allow fluid flow through the valve and the probe;

a portable receptacle attached to the probe for collecting fluid when the valve is actuated to the open position; and a portable pump to reduce the pressure in the receptacle to draw fluid through the conduit and into the receptacle, the portable pump being lightweight for manual transportation along with the portable receptacle.

2. A device in accordance with claim 1, further comprising a second coupling intermediate the probe and the portable receptacle and having a first passage communicating with the probe to allow fluid flow into the portable receptacle and a second passage communicating with the pump.

3. A device in accordance with claim 2 wherein the first passage of the second coupling extends into the portable receptacle beyond the second passage.

4. A device in accordance with claim 3 wherein the second coupling includes a filtering material in the second passage substantially preventing fluid flow through the second passage.

5. A device in accordance with claim 1 wherein the pump comprises an electrically driven pump that is selectively activated to reduce the pressure in the portable receptacle.

6. A device in accordance with claim 1 wherein the pump is a manual pump that is selectively operated to reduce the pressure in the portable receptacle to draw fluid into the portable receptacle when the probe actuates the valve to the open position.

7. A device in accordance with claim 1 wherein the portable receptacle is made of a substantially flexible material.

8. A device in accordance with claim 7 wherein the portable receptacle is made substantially of biodegradable material.

9. A device in accordance with claim 7 further comprises a portable shell being substantially rigid and being capable of substantially surrounding the portable receptacle.

10. A device in accordance with claim 9 wherein the portable shell further includes an openable portion for allowing the portable receptacle to be inserted therein and removed therefrom.

11. A device for recovering fluid from a reservoir having a lower drain comprising:

a first coupling connectable to a drain of a reservoir and having an internal passage for fluid flow therethrough;

a conduit having a first end connected to the first coupling for fluid flow into the conduit and a second end opposite the first end;

a valve at the second end of the conduit to control fluid flow through the conduit and being normally set to a closed position to prevent fluid flow therethrough;

a probe defining a fluid passage and having a tip portion for actuating the valve from the closed position to an open position upon insertion of the tip portion in the valve to allow fluid flow through the valve and the probe;

a portable receptacle attached to the probe for collecting fluid when the valve is actuated to the open position;

a portable pump to reduce the pressure in the receptacle to draw fluid through the conduit and into the receptacle, the portable pump being a manual pump that is selectively operated to reduce pressure in the portable receptacle to draw fluid into the portable receptacle when the probe actuates the valve to the open position; and the pump further comprising a compressible body portion having an expanded position and a collapsed position and an inlet and an outlet, the inlet allowing air to be draw from the receptacle as the bellow body normally shifts from the collapsed to the expanded position and the outlet allows air to discharge from the bellow body as the bellow body is manually shifted from the expanded position to the collapsed position.

12. A method for recovering fluid from a reservoir having a lower drain, comprising the steps of:

attaching a first coupling having an internal passage for fluid flow to a drain of a reservoir;

providing a conduit having a first end connected to the first coupling and a second end having a valve to control fluid flow through the conduit, the valve being normally set to a closed position to prevent fluid flow therethrough;

attaching a second coupling to a portable reservoir through which both air and fluid passes;

providing a probe capable of delivering fluid to the portable reservoir through the second coupling;

inserting the probe into the valve and actuating the valve to an open position with the probe to permit fluid flow therethrough the probe;

collecting fluid flowing through the conduit and the probe in the portable receptacle;

providing a portable pump being lightweight for manual transportation along with the portable receptacle;

activating the portable pump to draw air through the second coupling to reduce pressure in the portable receptacle to draw fluid through the conduit and into the portable receptacle; and disconnecting the probe from the valve to shift the valve to the closed position.

13. A method in accordance with claim 12 wherein the portable pump comprises a compressible body portion having an expanded position and a collapsed position and further comprising the steps of collapsing the compressible body and then allowing it to expand to reduce pressure in the portable receptacle to draw fluid through the conduit and into the portable receptacle.

14. A method in accordance with claim 12 wherein the portable receptacle is substantially flexible and further comprising the step of inserting the portable receptacle in a substantially rigid container.

15. A method in accordance with claim 12 further comprising the steps of locating the second end of the conduit above the reservoir after disconnecting the probe from the valve, removing the second coupling from the portable reservoir and sealing the portable reservoir to transport for disposal of the collected fluid.

16. A device for recovering fluid from a reservoir having a lower drain comprising:

a coupling connectable to a drain of a reservoir and having an internal passage for fluid flow therethrough;

a conduit having a first end connected to the first coupling for fluid flow into the conduit, a second end opposite the first end for discharging fluid flow from the conduit and a multi-layer construction between the first and second ends, the multi-layer construction having an inner layer with a friction reducing surface to enhance fluid flow therethrough and an outer layer to limit damage to the inner layer;

a removable closure sealing the second end of the conduit to prevent fluid discharge therefrom.

17. A device in accordance with claim 16 further comprising a motorized vehicle defining an outer perimeter, the reservoir being attached underneath the motorized vehicle and the conduit being substantially flexible and extendable to at least the outer perimeter of the motor vehicle.

18. A device in accordance with claim 17 wherein the conduit is in the range of one to five feet in length to extend to the outer perimeter of the motorized vehicle.

19. A device in accordance with claim 17 wherein the second end of the conduit is adapted to be connected to the motorized vehicle above the reservoir to reduce fluid pressure in the conduit at the second end.

20. A device in accordance with claim 17 wherein the inner and outer layers are separate inner and outer tubes, the inner tube being substantially within and substantially surrounded by the outer tube.

21. A device in accordance with claim 20 wherein the inner tube includes friction reducing material to allow fluid flow therethrough.

22. A device in accordance with claim 21 wherein the inner tube is made of synthetic resinous fluorine.

23. A device in accordance with claim 21 wherein the inner tube is made of polymeric material.

24. A device in accordance with claim 21 wherein the outer tube is made substantially of flexible metal structure to protect the inner tube.

25. A device in accordance with claim 21 wherein the outer tube is made substantially of a plastic material sufficient to protect the inner tube.

* * * * *